US010954087B2

(12) United States Patent
Lo et al.

(10) Patent No.: US 10,954,087 B2
(45) Date of Patent: Mar. 23, 2021

(54) MEDIA PATH

(71) Applicant: Hewlett-Packard Development Company, L.P., Spring, TX (US)

(72) Inventors: Kevin Lo, Vancouver, WA (US); Stephen Brown, Vancouver, WA (US); Raymond C Sherman, Vancouver, WA (US); Tim Longust, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/332,061

(22) PCT Filed: Sep. 12, 2016

(86) PCT No.: PCT/US2016/051347
§ 371 (c)(1),
(2) Date: Mar. 11, 2019

(87) PCT Pub. No.: WO2018/048448
PCT Pub. Date: Mar. 15, 2018

(65) Prior Publication Data

US 2019/0218049 A1 Jul. 18, 2019

(51) Int. Cl.
*B65H 5/06* (2006.01)
*B65H 5/38* (2006.01)
(Continued)

(52) U.S. Cl.
CPC ..... *B65H 5/062* (2013.01); *B41J 11/007* (2013.01); *B65H 5/38* (2013.01); *G03G 15/00* (2013.01);
(Continued)

(58) Field of Classification Search
CPC ..... B65H 5/062; B65H 29/125; B65H 2404/142; B65H 2404/1421;
(Continued)

(56) References Cited

U.S. PATENT DOCUMENTS 4,791,866 A 12/1988 Kanno et al.
5,236,339 A * 8/1993 Nishiumi ..... G07F 1/045 194/343
(Continued)

FOREIGN PATENT DOCUMENTS

CN 10392613 B 4/2015
JP 01192659 8/1989
(Continued)

OTHER PUBLICATIONS

Bukkems, B. et al. a Piecewise Linear Approach Towards Sheet Control in a Printer Paper Path, Jun. 14-16, 2006 ~ Proc American Control Conference ~ 6 pages.

*Primary Examiner* — David H Bollinger
(74) *Attorney, Agent, or Firm* — Dicke Billig & Czaja PLLC

(57) ABSTRACT

A media path includes a first media path portion, and a second media path portion opposed to the first media path portion, where the first media path portion and the second media path portion form the media path therebetween, and where, to open the media path, the first media path portion is rotatable relative to the second media path portion and the second media path portion is rotatable relative to the first media path portion.

15 Claims, 8 Drawing Sheets

(51) Int. Cl.
*G03G 15/00* (2006.01)
*B41J 11/00* (2006.01)

(52) U.S. Cl.
CPC ... *G03G 15/6529* (2013.01); *B65H 2404/144* (2013.01); *B65H 2404/1521* (2013.01); *B65H 2601/11* (2013.01); *B65H 2601/321* (2013.01); *G03G 2215/00544* (2013.01); *G03G 2215/00675* (2013.01); *G03G 2215/00679* (2013.01)

(58) Field of Classification Search
CPC ..... B65H 2404/1424; B65H 2404/144; B65H 2404/1441
USPC ..... 271/273, 314
See application file for complete search history.

(56) References Cited

U.S. PATENT DOCUMENTS 5,333,848 A * 8/1994 Rubscha ..... B65H 3/5261 271/117
5,953,575 A 9/1999 Park et al.
6,145,828 A * 11/2000 Arai ..... G03G 15/231 271/186
6,526,881 B2 3/2003 Iimura
6,718,872 B2 4/2004 Kanno
6,964,414 B2 11/2005 Willis
7,950,659 B2 * 5/2011 Matsushima ..... B65H 29/125 271/264
8,317,196 B2 * 11/2012 Tanaka ..... B65H 5/062 271/273
8,454,014 B2 * 6/2013 Kotera ..... B65H 5/062 271/272
2001/0042957 A1 * 11/2001 Luther ..... H04N 1/00615 271/273
2002/0152167 A1 * 10/2002 Kim ..... G06Q 20/1085 705/43
2005/0067773 A1 * 3/2005 Yoshida ..... B65H 5/00 271/264
2006/0103068 A1 * 5/2006 Sekiya ..... B65H 5/062 271/264
2007/0057448 A1 * 3/2007 Hiura ..... G03G 21/1638 271/273
2008/0079210 A1 4/2008 Nakada et al.
2011/0280625 A1 11/2011 Kushida et al.
2016/0152427 A1 6/2016 Ishikawa

FOREIGN PATENT DOCUMENTS

JP 867857 10/1996
JP 2006064727 3/2006
JP 2006259449 9/2006
JP 201020775 A 6/2010
WO WO-1988006974 A1 9/1988

* cited by examiner

MEDIA PATH

BACKGROUND

A printer may include a media path to move and/or route print media through the printer, and a print engine to print on the print media. To route the print media through the printer, the print media path may include a variety of guides, rollers, wheels, etc.

DETAILED DESCRIPTION

Figure 1:
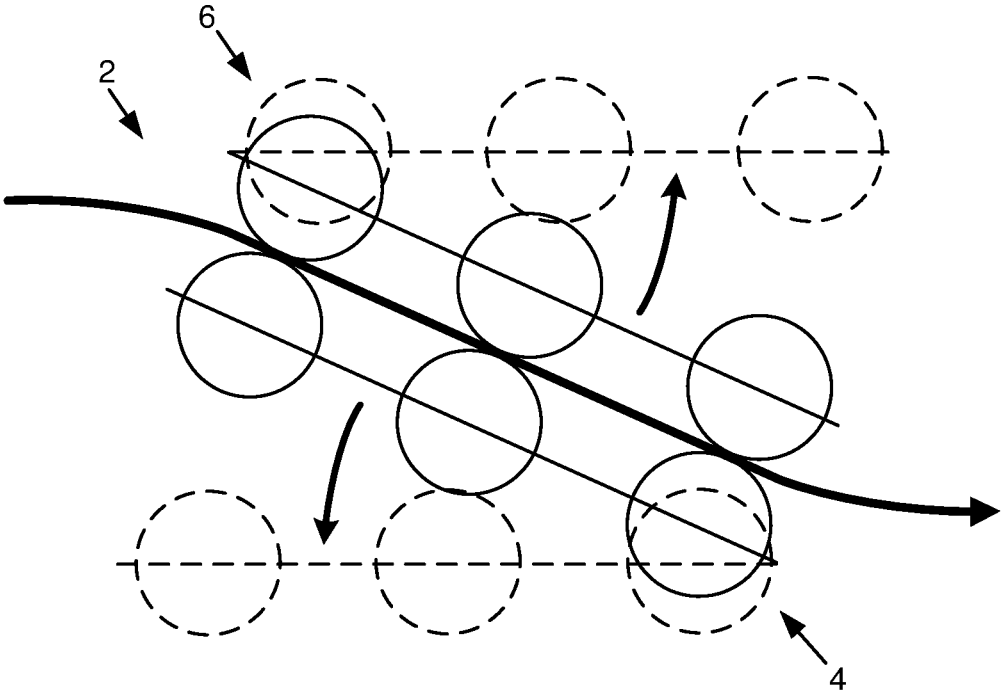
FIG. 1 is a schematic illustration of one example of a portion of a media path for a printer.

As illustrated in the example of FIG. 1, the present disclosure provides a media path 2 including a first media path portion 4 and a second media path portion 6 opposed to the first media path portion, where the first media path portion and the second media path portion form the media path therebetween. In one implementation, to open the media path, the first media path portion is rotatable relative to the second media path portion and the second media path portion is rotatable relative to the first media path portion.

Figure 2:
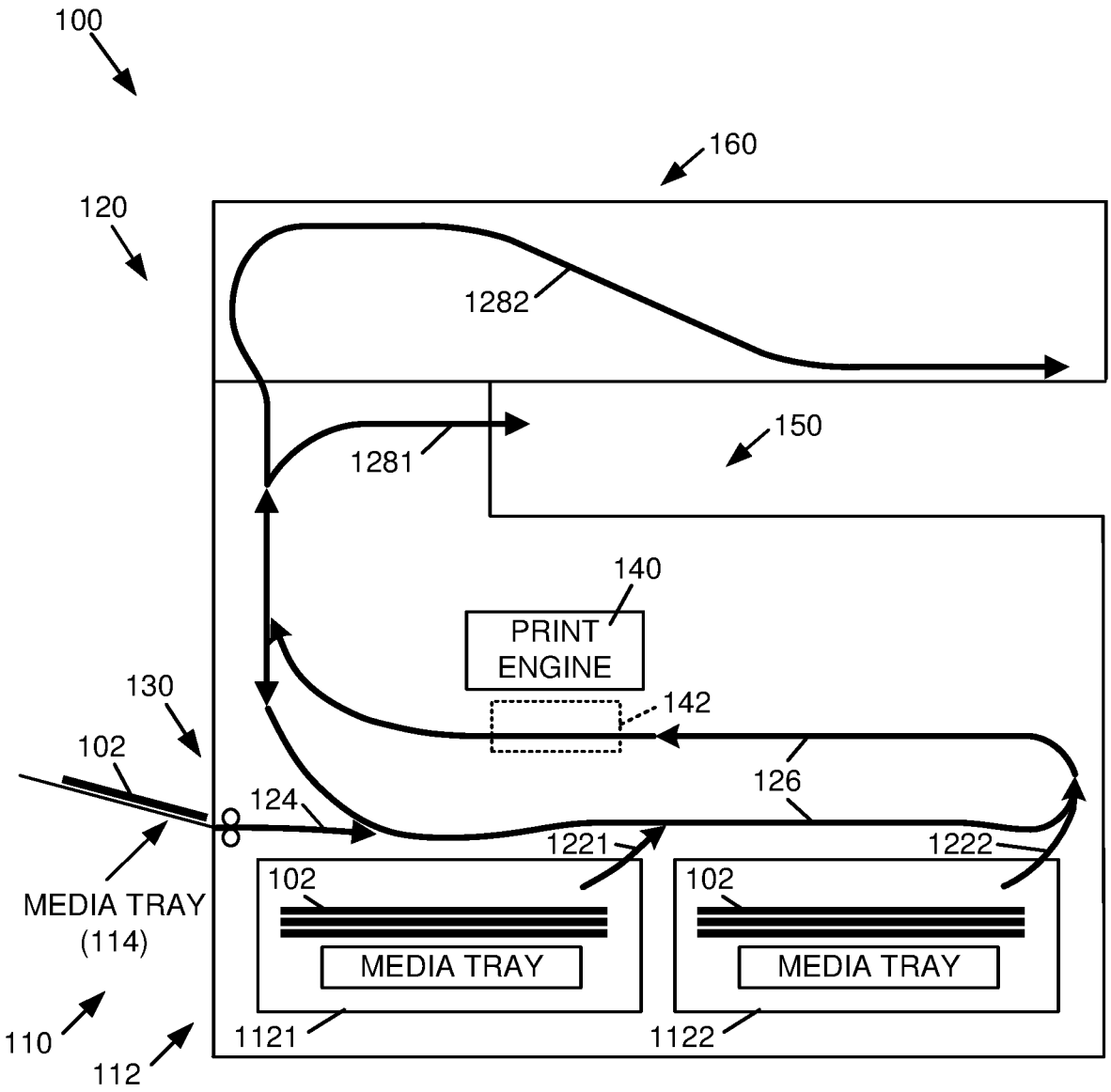
FIG. 2 is a schematic illustration of one example of a portion of a printer.

FIG. 2 is a schematic illustration of one example of a portion of a printer 100. In one implementation, printer 100 includes an input tray or trays 110 to supply print media 102, a media path 120 to route print media 102 within printer 100, a pick system or pick assembly 130 to pick print media 102 from input tray or trays 110 and feed print media 102 to media path 120, and a print engine 140 to print on print media 102 along media path 120.

Input tray or trays 110 supply a bulk quantity of print media 102 or supply a single quantity of print media 102 to print engine 140 for printing on print media 102 by print engine 140. Print media 102 may include, for example, sheet material, such as paper, card stock, transparencies, Mylar, and the like, as well as envelopes, letterhead, checks, fabric, or other print media. In one implementation, input trays 110 include a media tray 112 and a multi-purpose media tray 114.

In one implementation, media tray 112 is a tandem media tray set including media trays 1121 and 1122. Media trays 1121 and 1122 are positioned side-by-side or laterally of each other, and each hold a separate quantity of print media 102. Although illustrated and described as a tandem media tray set, media tray 112 may include a single media tray.

In one implementation, multi-purpose media tray 114 is a manual or bypass media tray and receives manual input of print media 102 from externally of printer 100 including, for example, envelopes, letterhead, checks, fabric, or other print media suited for single or manual input. Multi-purpose media tray 114 may also support quantities of print media such as multi-sheet stacks of print media for input to printer 100.

Print engine 140 can be a laser print engine, an inkjet print engine, or any other type of print engine. In one implementation, a print area or print zone 142 is defined in which printing on print media 102 by print engine 140 occurs. In one example, printer 100 is implemented as an inkjet printing system, and print engine 140 includes, for example, a printhead assembly.

In one example, printer 100 includes an output tray or bin 150 and an output device 160 such that printed print media 102 may be selectively routed to output tray or bin 150 or output device 160. In one implementation, output device 160 routes printed print media 102 to an additional output device, such as a finisher or collator.

Print media path 120 routes print media 102 through printer 100 for printing on print media 102 by print engine 140 and handling of print media 102 after printing by print engine 140. More specifically, print media path 120 routes print media 102 from one or more of input trays 110, to and through print zone 142 of print engine 140, and to output bin 150 or output device 160. To achieve the handling and routing of print media 102, print media path 120 may include a variety of guides, rollers, wheels, etc.

In one implementation, print media path 120 includes input path portions 1221 and 1222, an input path portion 124, a print path portion or portions 126, and output path portions 1281 and 1282. In one example, input path portions 1221 and 1222 communicate with and receive input of print media 102 from respective media trays 1121 and 1122, input path portion 124 communicates with and receives input of print media 102 from multi-purpose media tray 114, print path portion or portions 126 direct print media 102 through print zone 142 for printing on print media 102 by print engine 140, output path portion 1281 directs print media 102 to output bin 150, and output path portion 1282 directs print media 102 to and/or through output device 160. In one implementation, output path portion 1282 of media path 120 routes print media 102 to an additional output device, such as a finisher or collator.

Figure 3A:
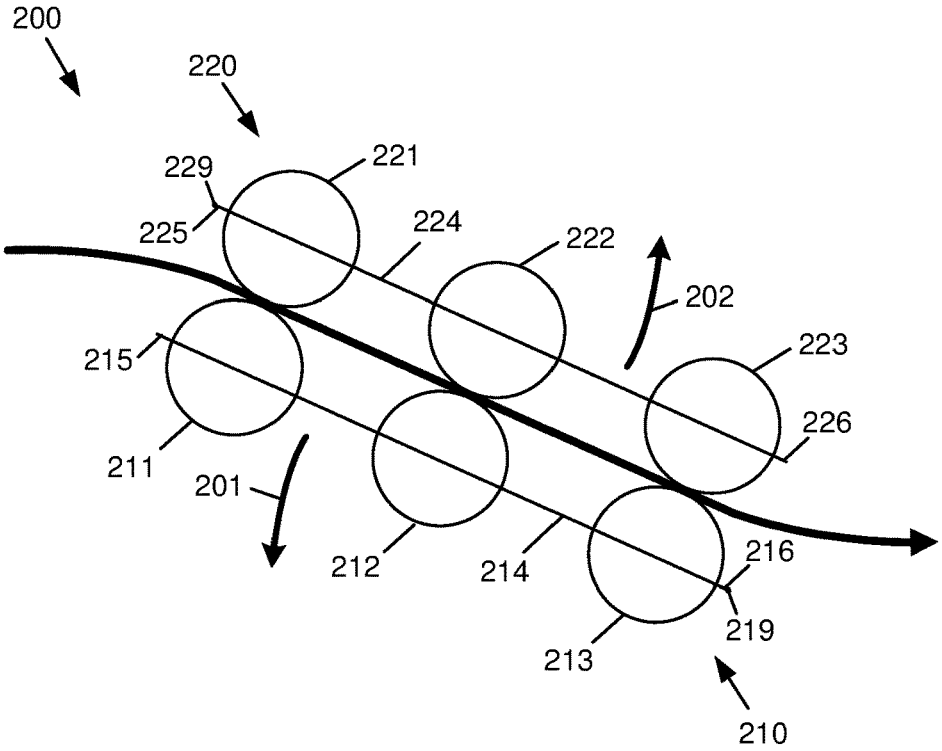
FIGS. 3A and 3B schematically illustrate one example of a portion of a media path for a printer in a closed position and an open position, respectively.
Figure 3B:
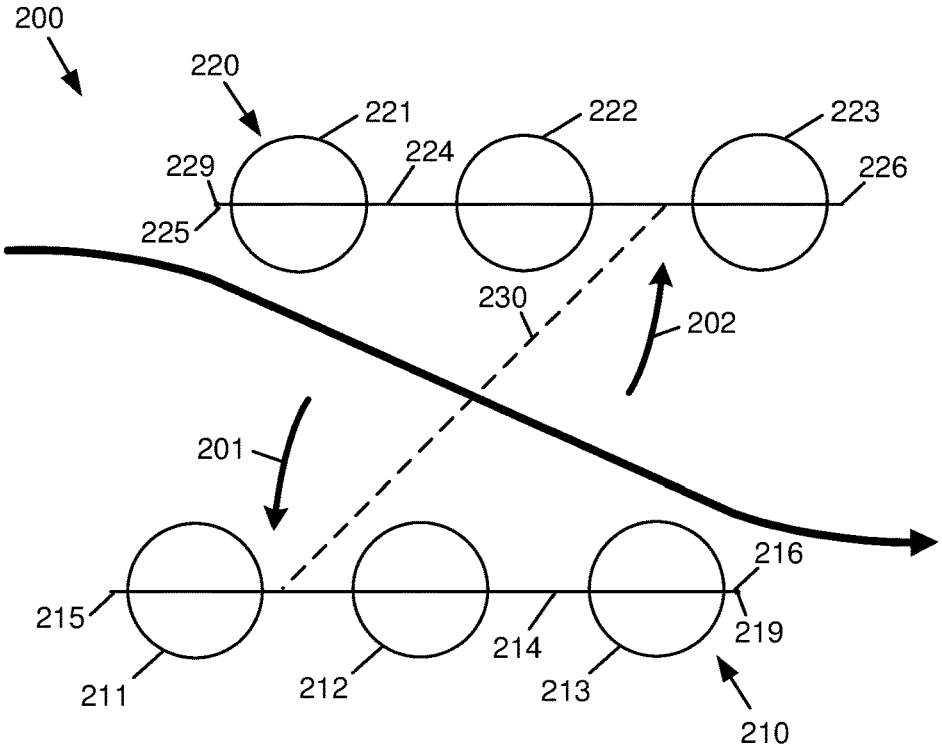
Figure 4A:
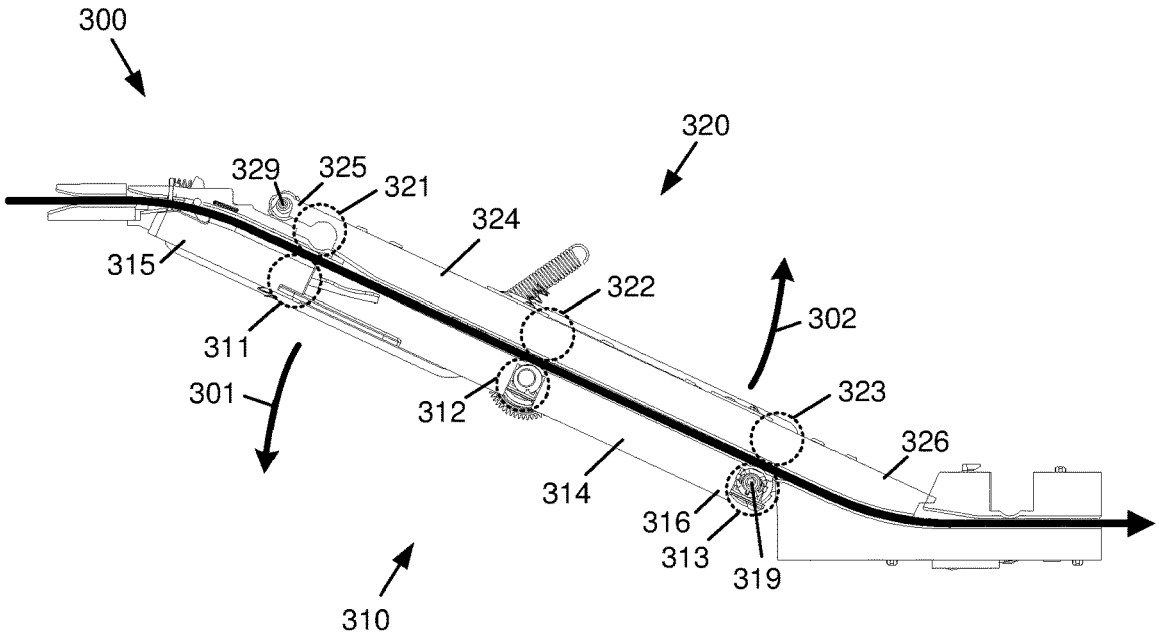
FIGS. 4A and 4B, and 5A and 5B are front and front perspective views, respectively, of one example of a portion of a media path for a printer in a closed position and an open position, respectively.
Figure 4B:
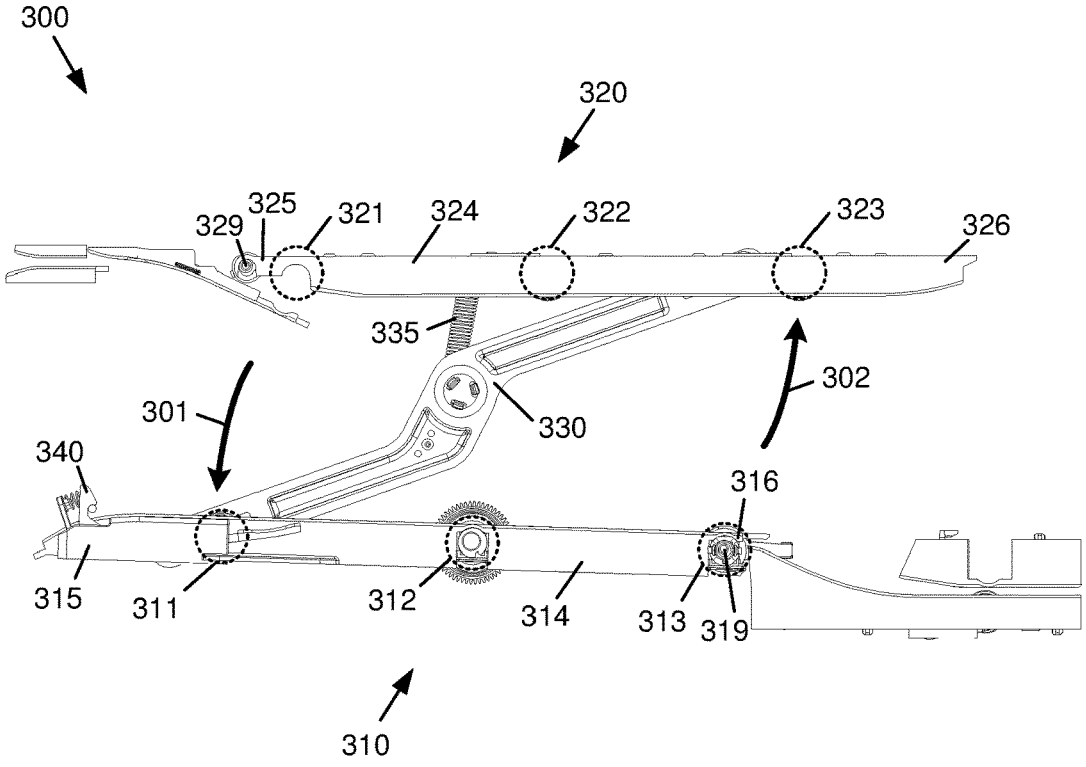
Figure 5A:
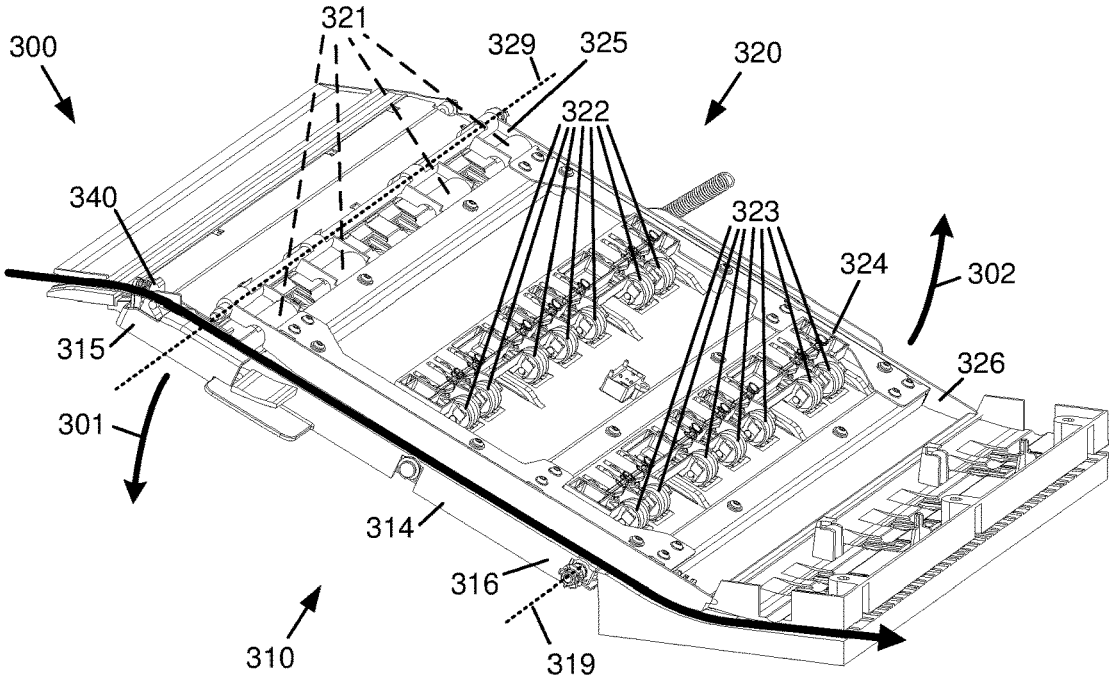
Figure 5B:
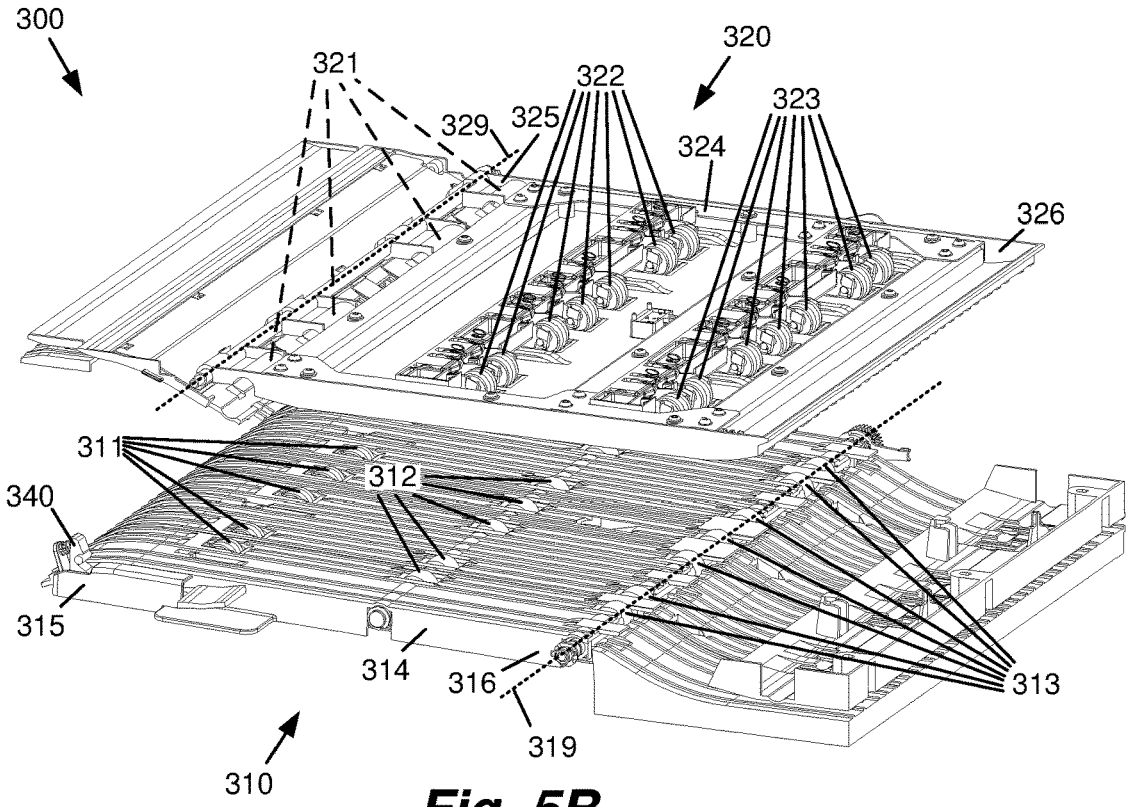
Figure 6A:
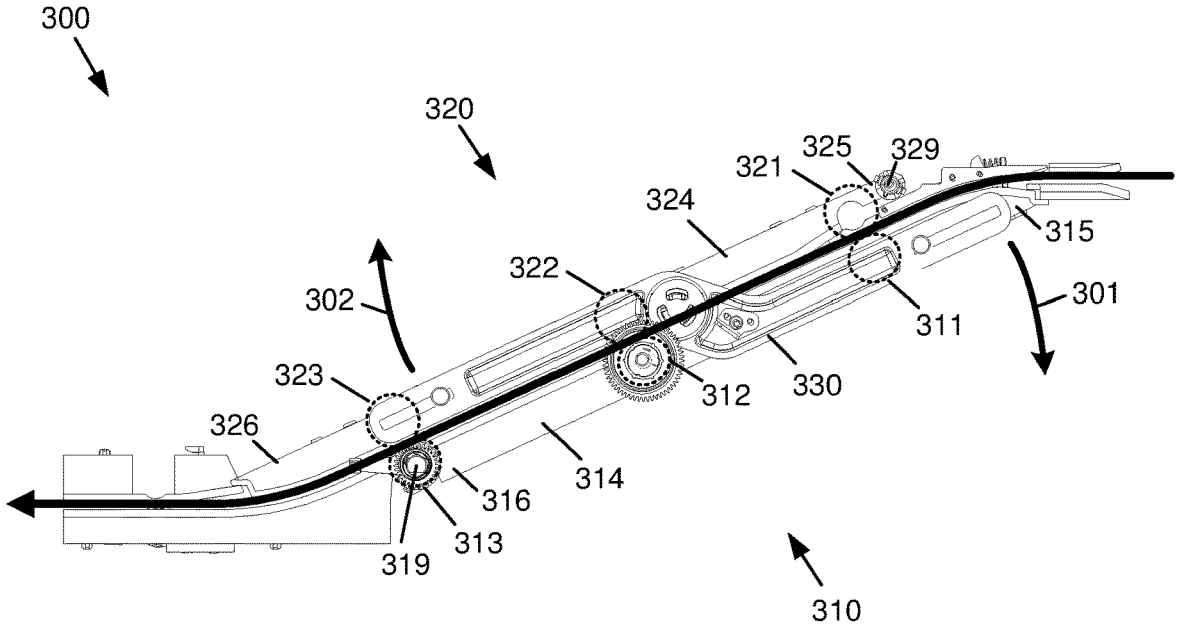
FIGS. 6A and 6B, and 7A and 7B are back and back perspective views, respectively, of the example of the portion of the media path for a printer of FIGS. 4A and 4B, and 5A and 5B in the closed position and the open position, respectively.
Figure 6B:
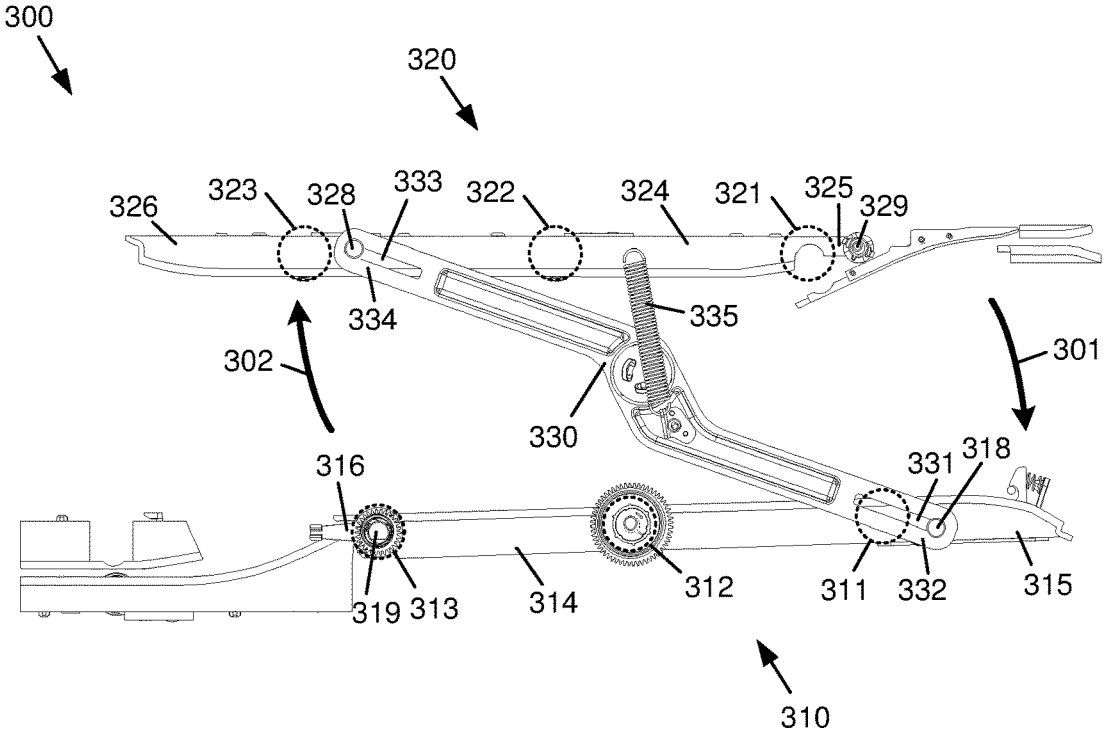
Figure 7A:
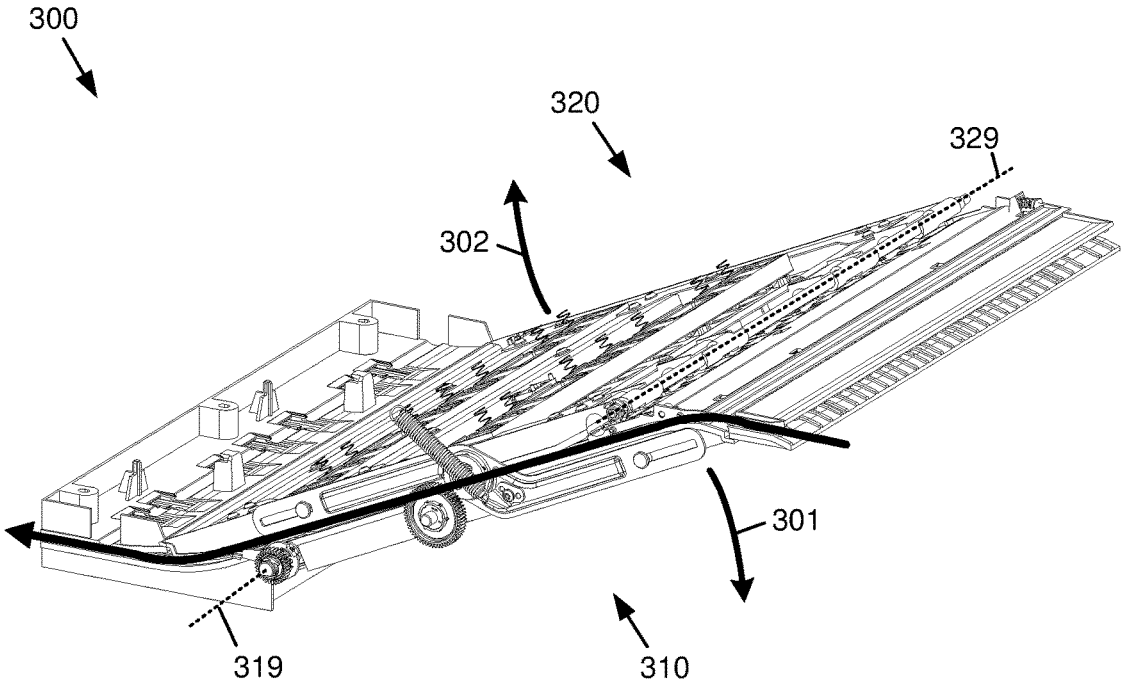
Figure 7B:
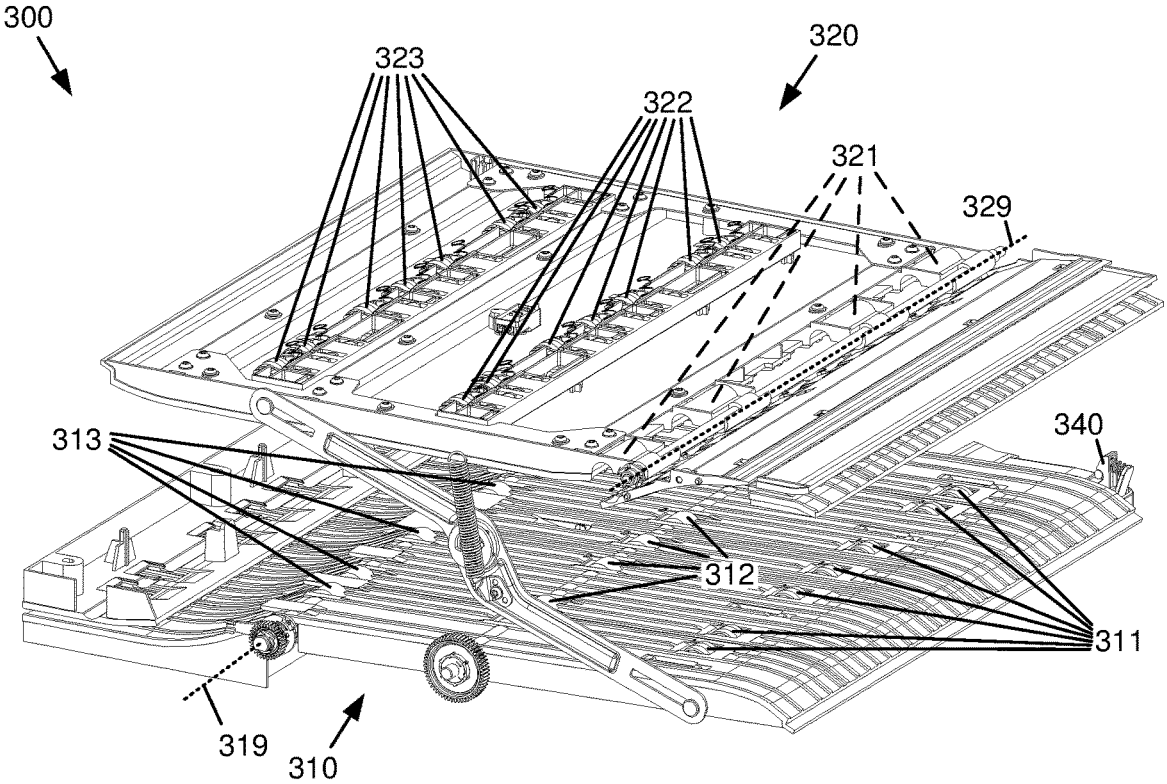

FIGS. 3A and 3B schematically illustrate one example of a portion of a media path 200 for a printer, such as output path portion 1282 of media path 120 for printer 100 (FIG. 2). In one implementation, media path 200 includes a media path portion 210, representing, in one example, a lower media path portion, and a media path portion 220, representing, in one example, an upper media path portion, such that media path 200 is formed by and between media path portion 210 and media path portion 220.

In one example, media path 200 includes a series of opposing rollers and/or wheels, including starwheels, to contact and guide and/or route print media, such as print media 102 (FIG. 2), along and/or through media path 200. For example, media path portion 210 includes rollers 211, 212, and 213 and media path portion 220 includes rollers 221, 222, and 223 to contact and guide and/or route print media along and/or through media path 200. In one implementation, rollers 211, 212, and 213 contact one side of print media in media path 200, and rollers 221, 222, and 223 contact an opposite side of print media in media path 200. As such, rollers 211, 212, and 213, and rollers 221, 222, and 223 represent print media contact elements of print media path 200.

In one example, rollers 211, 212, and 213 of media path portion 210 and rollers 221, 222, and 223 of media path portion 220 are positioned opposite each other such that opposing roller pairs 211 and 221, opposing roller pairs 212 and 222, and opposing roller pairs 213 and 223 each form a nip therebetween. In one implementation, rollers 221, 212, and 213 constitute drive rollers of media path 200, and rollers 211, 222, and 223 constitute pinch rollers of media path 200. Although illustrated as rollers, rollers 211, 222, and/or 223 may include starwheels.

Although one roller 211, one roller 212, and one roller 213 is illustrated and described, multiple rollers 211, multiple rollers 212, and/or multiple rollers 213 may be provided for media path portion 210. In addition, although one roller 221, one roller 222, and one roller 223 is illustrated and described, multiple rollers 221, multiple rollers 222, and/or multiple rollers 223 may be provided for media path portion 220.

In one example, media path portion 210 includes a supporting structure or frame 214 and media path portion 220 includes a supporting structure or frame 224 such that rollers 211, 212, and 213 are rotatably mounted on or rotatably supported by frame 214, and rollers 221, 222, and 223 are rotatably mounted on or rotatably supported by frame 224.

In one example, a linkage 230 extends between media path portion 210 and media path portion 220 including, more specifically, between frame 214 of media path portion 210 and frame 224 of media path portion 220, to facilitate and/or assist in opening and/or closing of media path 200, as described below. In one example, movement, actuation or operation of linkage 230 provides for substantially simultaneous movement of media path portion 210 and media path portion 220 in opening and/or closing of media path 200. In one implementation, linkage 230 is pivotably or rotatably connected with media path portion 210 and media path portion 220. In one example, linkage 230 is an over-center mechanism to bias media path 200 to the open and closed positions described below.

As schematically illustrated in the example of FIG. 3A, media path 200 is "closed" such that media path portion 210 and media path portion 220 are positioned proximate each other to contact and guide and/or route print media through media path 200. More specifically, in one example, with media path 200 closed, opposing roller pairs 211 and 221, opposing roller pairs 212 and 222, and opposing roller pairs 213 and 223 are in contact with each other in media path 200 to guide and/or route print media through media path 200.

As schematically illustrated in the example of FIG. 3B, media path 200 is "open" such that media path portion 210 and media path portion 220 are spaced from each other. More specifically, in one example, with media path 200 open, opposing roller pairs 211 and 221, opposing roller pairs 212 and 222, and opposing roller pairs 213 and 223 are spaced from each other and are out of contact with each other in media path 200.

In one example, to open media path 200, media path portion 210 and media path portion 220 are moved away from each other. More specifically, media path portion 210 is moved away from media path portion 220, as represented, for example, by arrow 201 (FIG. 3A), and media path portion 220 is moved away from media path portion 210, as represented, for example, by arrow 202 (FIG. 3A).

In one implementation, to move media path portion 210 and media path portion 220 away from each other and open media path 200, media path portion 210 is rotated relative to media path portion 220, and media path portion 220 is rotated relative to media path portion 210. More specifically, media path portion 210 is rotated away from media path portion 220 in a first direction (downward in the illustrated example) and media path portion 220 is rotated away from media path portion 210 in a second direction opposite the first direction (upward in the illustrated example).

In one implementation, media path portion 210 including, more specifically, frame 214 of media path portion 210, has an end 215 and an end 216 opposite end 215, and media path portion 220 including, more specifically, frame 224 of media path portion 220, has an end 225 and an end 226 opposite end 225. In one example, to move media path portion 210 and media path portion 220 away from each other and open media path 200, media path portion 210 is rotated or pivoted in one direction relative to media path portion 220 about an axis 219 at or near end 216, and media path portion 220 is rotated or pivoted in an opposite direction relative to media path portion 210 about an axis 229 at or near end 225. As such, media path portion 210 and media path portion 220 are rotated or pivoted relative to each other about opposite ends thereof in opposite directions to open media path 200.

In one example, media path 200 includes an angled segment oriented at a non-zero, non-orthogonal angle to provide a transition between two substantially parallel segments each oriented substantially horizontal. As such, in one example, in the closed position (e.g., FIG. 3A), media path portion 210 and media path portion 220 are each oriented at the non-zero, non-orthogonal angle, and are oriented substantially parallel with each other. In addition, in one example, in the open position (e.g., FIG. 3B), media path portion 210 and media path portion 220 are oriented substantially parallel with each other. More specifically, in the open position, media path portion 210 and media path portion 220 are each oriented substantially horizontal.

FIGS. 4A and 4B, FIGS. 5A and 5B, FIGS. 6A and 6B, and FIGS. 7A and 7B illustrate front, front perspective, back, and back perspective views, respectively, of one example of a portion of a media path 300 for a printer, such as media path 200, as an example of media path portion 1282 of media path 120 for printer 100 (FIG. 2), in a closed position and an open position, respectively. In one implementation, similar to media path 200, media path 300 includes a media path portion 310 and a media path portion 320 such that media path 300 is formed by and between media path portion 310 and media path portion 320.

In one example, similar to media path portion 210, media path portion 310 includes rollers 311, 312, and 313 and, similar to media path portion 220, media path portion 320 includes rollers 321, 322, and 323 to contact and guide and/or route print media along and/or through media path 300. In one example, rollers 311, 312, and 313 of media path portion 310 and rollers 321, 322, and 323 of media path portion 320 are positioned opposite each other such that opposing rollers 311 and 321, opposing rollers 312 and 322, and opposing rollers 313 and 323 each form a nip therebetween. In one implementation, rollers 321, 312, and 313 constitute drive rollers of media path 300, and rollers 311, 322, and 323 constitute pinch rollers of media path 300.

In one example, similar to media path portion 210, media path portion 310 includes a supporting structure or frame 314 and, similar to media path portion 220, media path portion 320 includes a supporting structure or frame 324 such that rollers 311, 312, and 313 are rotatably mounted on or rotatably supported by frame 314, and rollers 321, 322, and 323 are rotatably mounted on or rotatably supported by frame 324.

In one example, similar to linkage 230, a linkage 330 extends between media path portion 310 and media path portion 320 including, more specifically, between frame 314 of media path portion 310 and frame 324 of media path portion 320, to facilitate and/or assist in opening and/or closing of media path 300, as described below. In one example, movement, actuation or operation of linkage 330 provides for substantially simultaneous movement of media path portion 310 and media path portion 320 in opening and/or closing of media path 300. In one implementation, linkage 330 is pivotably or rotatably connected with media path portion 310 and media path portion 320. For example, in one implementation, media path portion 310 includes a pin 318 slidingly fit within a slot 331 provided at an end 332 of linkage 330 (e.g., FIG. 6B), and media path portion 320 includes a pin 328 slidingly fit within a slot 333 provided at an end 334 of linkage 330 (e.g., FIG. 6B).

In one example, linkage 330 is an over-center mechanism to bias media path 300 to the open and closed positions described below. In one implementation, linkage 330 is biased (for example, by a spring 335) to pull media path portion 310 and media path portion 320 together when moving 310 and 320 to the closed position. In addition, in one example, a latch 340 (e.g., FIGS. 5A and 5B) is provided to assist in holding media path portion 310 and media path portion 320 in the closed position. In one implementation, latch 340 is spring biased to hold media path portion 310 and media path portion 320 in the closed position, and may be operated against the spring bias to move media path portion 310 and media path portion 320 to the open position.

As schematically illustrated in the example of FIGS. 4A, 5A, 6A, and 7A, media path 300 is "closed" such that media path portion 310 and media path portion 320 are positioned proximate each other to contact and guide and/or route print media through media path 300. More specifically, in one example, with media path 300 closed, opposing rollers 311 and 321, opposing rollers 312 and 322, and opposing rollers 313 and 323 are in contact with each other in media path 300 to guide and/or route print media through media path 300.

As schematically illustrated in the example of FIGS. 4B, 5B, 6B, and 7B, media path 300 is "open" such that media path portion 310 and media path portion 320 are spaced from each other. More specifically, in one example, with media path 300 open, opposing rollers 311 and 321, opposing rollers 312 and 322, and opposing roller pairs rollers 313 and 323 are spaced from each other and are out of contact with each other in media path 300.

In one example, similar to media path 200, to open media path 300, media path portion 310 and media path portion 320 are moved away from each other. More specifically, media path portion 310 is moved away from media path portion 320, as represented, for example, by arrow 301 (FIGS. 4A, 5A, 6A, and 7A), and media path portion 320 is moved away from media path portion 310, as represented, for example, by arrow 302 (FIGS. 4A, 5A, 6A, and 7A).

In one implementation, similar to media path portion 210 and media path portion 220, to move media path portion 310 and media path portion 320 away from each other and open media path 300, media path portion 310 is rotated relative to media path portion 320, and media path portion 320 is rotated relative to media path portion 310. More specifically, media path portion 310 is rotated away from media path portion 320 in a first direction (downward in the illustrated example) and media path portion 320 is rotated away from media path portion 310 in a second direction opposite the first direction (upward in the illustrated example).

In one implementation, similar to media path portion 210 and media path portion 220, media path portion 310 including, more specifically, frame 314 of media path portion 310, has an end 315 and an end 316 opposite end 315, and media path portion 320 including, more specifically, frame 324 of media path portion 320, has an end 325 and an end 326 opposite end 325. In one example, to move media path portion 310 and media path portion 320 away from each other and open media path 300, media path portion 310 is rotated or pivoted in one direction relative to media path portion 320 about an axis 319 at or near end 316, and media path portion 320 is rotated or pivoted in an opposite direction relative to media path portion 310 about an axis 329 at or near end 325. As such, media path portion 310 and media path portion 320 are rotated or pivoted relative to each other about opposite ends thereof in opposite directions to open media path 300.

Figure 8:
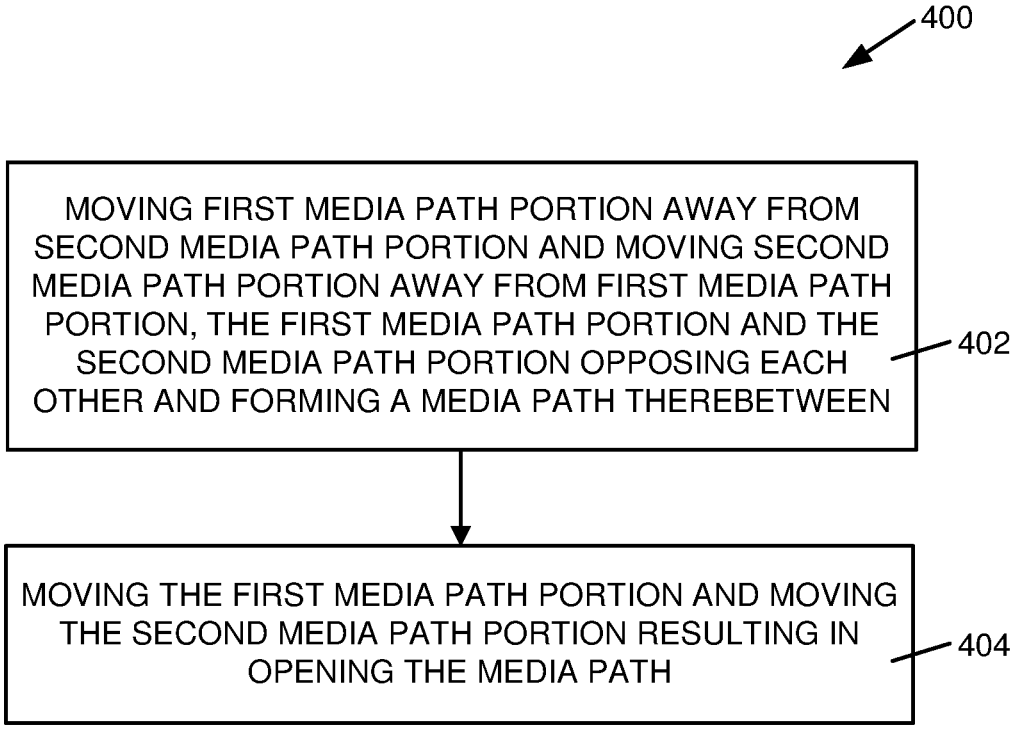
FIG. 8 is a flow diagram illustrating one example of a method of opening a media path of a printer.

FIG. 8 is a flow diagram illustrating one example of a method 400 of opening a media path of a printer, such as media path 200, as illustrated, for example, in FIGS. 3A and 3B, and media path 300, as illustrated, for example, in FIGS. 4A and 4B, FIGS. 5A and 5B, FIGS. 6A and 6B, and FIGS. 7A and 7B.

At 402, method 400 includes moving a first media path portion away from a second media path portion and moving the second media path portion away from the first media path portion, with the first media path portion and the second media path portion opposing each other and forming the media path therebetween, such as media path portion 210 and media path portion 220 forming media path 200 therebetween, as illustrated, for example, in FIGS. 3A and 3B, or media path portion 310 and media path portion 320 forming media path 300 therebetween, as illustrated, for example, in FIGS. 4A and 4B, FIGS. 5A and 5B, FIGS. 6A and 6B, and FIGS. 7A and 7B.

In one example, moving the first media path portion and moving the second media path portion, for example, at 402, includes rotating the first media path portion in a first direction (e.g., downward in the illustrated example) and rotating the second media path portion in a second direction opposite the first direction (e.g., upward in the illustrated example).

In one implementation, moving the first media path portion and moving the second media path portion, for example, at 402, includes pivoting the first media path portion about a first end thereof, such as end 216 of media path portion 210, as illustrated, for example, in FIG. 3B or end 316 of media path portion 310, as illustrated, for example, in FIGS. 4B, 5B, 6B, and 7B, and pivoting the second media path portion about a second end thereof, such as end 225 of media path portion 220, as illustrated, for example, in FIG. 3B or end 325 of media path portion 320, as illustrated, for example, in FIGS. 4B, 5B, 6B, and 7B, with the second end of the second media path portion positioned opposite the first end of the first media path portion.

At 404, moving the first media path portion and moving the second media path portion results in opening the media path, such as opening media path 200, as illustrated, for example, in FIG. 3B, or opening media path 300, as illustrated, for example, in FIGS. 4B, 5B, 6B, and 7B.

In one example, opening the media path, for example, at 404, includes moving a first print media contact element of the first media path portion, such as roller 211, roller 212, and/or roller 213 of media path portion 210, as illustrated, for example, in FIG. 3B, or roller 311, roller 312, and/or roller 313 of media path portion 310, as illustrated, for example, in FIGS. 4B, 5B, 6B, and 7B, and a second print media contact element of the second media path portion, such as roller 221, roller 222, and/or roller 223 of media path portion 220, as illustrated, for example, in FIG. 3B, or roller 321, roller 322, and/or roller 323 of media path portion 320, as illustrated, for example, in FIGS. 4B, 5B, 6B, and 7B, out of contact in the media path.

In routing print media along a media path, print media may become stuck or jammed. With a media path as illustrated and described herein, including, more specifically, opening a media path as illustrated and described herein, media jams may be more easily cleared. For example, by moving lower and upper media path portions away from each other, as illustrated and described herein, significant access to the media path is provided.

Although specific examples have been illustrated and described herein, a variety of alternate and/or equivalent implementations may be substituted for the specific examples illustrated and described without departing from the scope of the present disclosure. This application is intended to cover any adaptations or variations of the specific examples illustrated and described herein.

The invention claimed is:

1. A media path, comprising:

a first media path portion including a first supporting structure; and a second media path portion opposed to the first media path portion and including a second supporting structure, the first media path portion and the second media path portion to form the media path therebetween, and to open the media path, the first supporting structure of the first media path portion rotatable away from the second supporting structure of the second media path portion and the second supporting structure of the second media path portion rotatable away from the first supporting structure of the first media path portion.

2. The media path of claim 1, wherein, to open the media path, the first supporting structure of the first media path portion is rotatable away from the second supporting structure of the second media path portion in a first direction and the second supporting structure of the second media path portion is rotatable away from the first supporting structure of the first media path portion in a second direction opposite the first direction.

3. The media path of claim 1, wherein, to open the media path, the first supporting structure of the first media path portion is pivotable about a first end thereof and the second supporting structure of the second media path portion is pivotable about a second end thereof, a first end of the second supporting structure of the second media path portion adjacent the first end of the first supporting structure of the first media path portion and a second end of the first supporting structure of the first media path portion adjacent the second end of the second supporting structure of the second media path portion.

4. The media path of claim 1, wherein the first media path portion includes a first print media contact element supported by the first supporting structure to contact a first side of a print media in the media path and the second media path portion includes a second print media contact element supported by the second supporting structure to contact a second side of the print media opposite the first side of the print media, the first print media contact element and the second print media contact element to contact in the media path, wherein, with the media path open, the first print media contact element and the second print media contact element are out of contact in the media path.

5. The media path of claim 4, wherein one of the first print media contact element and the second print media contact element comprises a drive roller, and the other of the first print media contact element and the second print media contact element comprises a pinch roller.

6. The media path of claim 1, wherein, with the media path open, the first media path portion and the second media path portion are oriented substantially parallel with each other, and, with the media path closed, the first media path portion and the second media path portion are oriented substantially parallel with each other.

7. A printer, comprising:

a print engine to print on print media; and a media path to route the print media, the media path including a first frame to support a first roller to contact a first side of the print media and a second frame to support a second roller opposed to the first roller to contact a second side of the print media opposite the first side of the print media, the first roller and the second roller to form a nip therebetween, and the first frame to move the first roller in a first direction away from the second roller and the second frame to move the second roller in a second direction opposite the first direction away from the first roller to open the nip.

8. The printer of claim 7, wherein the first frame is to rotate away from the second frame in the first direction and the second frame is to rotate away from the first frame in the second direction opposite the first direction to open the nip.

9. The printer of claim 7, wherein the first frame is to pivot in the first direction about a first end thereof and the second frame is to pivot in the second direction opposite the first direction about a second end thereof to open the nip, the first end of the first frame and the second end of the second frame provided at respective opposite ends thereof.

10. The printer of claim 7, further comprising:

a linkage extended between the first frame and the second frame to move the first frame and the second frame relative to each other to open the nip.

11. A method of opening a media path, comprising:

moving a first media path portion away from a second media path portion and moving the second media path portion away from the first media path portion, the first media path portion and the second media path portion opposing each other and forming the media path therebetween, the moving the first media path portion and the moving the second media path portion resulting in opening the media path.

12. The method of claim 11, wherein the moving the first media path portion includes rotating the first media path portion in a first direction and the moving the second media path portion includes rotating the second media path portion in a second direction opposite the first direction.

13. The method of claim 11, wherein the moving the first media path portion includes pivoting the first media path portion about a first end thereof and the moving the second media path portion includes pivoting the second media path portion about a second end thereof, the second end of the second media path portion positioned opposite the first end of the first media path portion.

14. The method of claim 11, wherein the first media path portion includes a first print media contact element and the second media path portion includes a second print media contact element, the first print media contact element and the second print media contact element contacting in the media path, wherein the opening the media path includes moving the first print media contact element and the second print media contact element out of contact in the media path.

15. The method of claim 14, wherein one of the first print media contact element and the second print media contact element comprises a drive roller, and the other of the first print media contact element and the second print media contact element comprises a pinch roller.

* * * * *